US009707587B2

(12) United States Patent
Perez

(10) Patent No.: US 9,707,587 B2
(45) Date of Patent: Jul. 18, 2017

(54) INTERRUPTIBLE SPRINKLER HEAD

(71) Applicant: Mario Todd Perez, Delray Beach, FL (US)

(72) Inventor: Mario Todd Perez, Delray Beach, FL (US)

(73) Assignee: STREAMLINE SPRINKLER COMPANY LLC, Delray Beach, FL (US)

( * ) Notice: Subject to any disclaimer, the term of this patent is extended or adjusted under 35 U.S.C. 154(b) by 0 days.

(21) Appl. No.: 14/711,227

(22) Filed: May 13, 2015

(65) Prior Publication Data

US 2015/0328656 A1 Nov. 19, 2015

Related U.S. Application Data

(60) Provisional application No. 61/993,115, filed on May 14, 2014.

(51) Int. Cl.
*B05B 15/10* (2006.01)
*B05B 1/30* (2006.01)

(52) U.S. Cl.
CPC ..... *B05B 15/10* (2013.01); *B05B 1/3026* (2013.01)

(58) Field of Classification Search
CPC ..... B05B 15/10; B05B 1/3026; B05B 1/1654; B05B 1/30; B05B 1/1645
USPC ..... 239/203, 204, 581.1, 391, 392, 394
See application file for complete search history.

(56) References Cited

U.S. PATENT DOCUMENTS 26,994 A * 1/1860 Hotz ..... F16K 47/08 137/625.3
1,278,926 A * 9/1918 Tyrrell ..... B05B 7/1209 137/628
1,790,358 A * 1/1931 Henrikson et al. ..... B05B 15/10 239/204
3,094,283 A * 6/1963 Balister ..... B23Q 11/1076 239/393
3,589,616 A * 6/1971 Stephens ..... B05B 15/10 239/204
3,982,698 A * 9/1976 Anderson ..... B05B 1/1654 239/394
4,434,855 A 3/1984 Given, Jr.
4,681,259 A 7/1987 Troup et al.
4,784,325 A 11/1988 Walker et al.
4,790,481 A 12/1988 Ray et al.
5,226,599 A 7/1993 Lindermeir et al.
(Continued)

*Primary Examiner* — Jason Boeckmann
(74) *Attorney, Agent, or Firm* — Duane Morris LLP; J. Rodman Steele, Jr.; Gregory M. Lefkowitz

(57) ABSTRACT

In some embodiments, a sprinkler head is disclosed. The sprinkler head can include a spray stem comprising an upper stem rotatably coupled to a base stem; a spray nozzle coupled to a distal end of the upper stem; and a connector for removably coupling the sprinkler head to a pressurized liquid source. An interior cavity of the base stem can be in fluid communication with an interior cavity of the connector, and the upper stem can rotate between an operational position where an upper stem interior cavity is in fluid communication with the base stem interior cavity and a maintenance position where the upper stem interior cavity is not in fluid communication with the base stem interior cavity. A pop-up sprinkler head including the spray stem described herein is also described.

18 Claims, 14 Drawing Sheets

(56) References Cited

U.S. PATENT DOCUMENTS

| | | | |
|---|---|---|---|
| 6,568,608 | B2 | 5/2003 | Sirkin |
| 6,799,732 | B2 | 10/2004 | Sirkin |

* cited by examiner

INTERRUPTIBLE SPRINKLER HEAD

CROSS-REFERENCE TO RELATED APPLICATIONS

This application claims priority to U.S. Provisional Patent Application No. 61/993,115, filed May 14, 2014, the entirety of which is incorporated by reference herein.

FIELD OF THE INVENTION

The present invention relates generally to an interruptible sprinkler head, particularly, a sprinkler head with a spray stem that rotates between an operational position and a maintenance position.

BACKGROUND

Sprinkler heads are an important part of both portable and underground sprinkler systems. However, sprinkler heads often break, which can waste water and significantly reduce the ability of the sprinkler system to distribute water over the intended area. One of the most efficient technique for determining whether a sprinkler head is broken is to turn on the water and see if any of the sprinkler heads are broken. This results in many trips back-and-forth to turn the water on and off. There are many areas for improvement in making sprinkler heads and sprinkler systems more reliable.

SUMMARY

In some embodiments, a sprinkler head is disclosed. The sprinkler head can include a spray stem comprising an upper stem rotatably coupled to a base stem; a spray nozzle coupled to a distal end of the upper stem; and a connector for removably coupling the sprinkler head to a pressurized liquid source. An interior cavity of the base stem can be in fluid communication with an interior cavity of the connector, and the upper stem can rotate between an operational position where an upper stem interior cavity is in fluid communication with the base stem interior cavity and a maintenance position where the upper stem interior cavity is not in fluid communication with the base stem interior cavity.

In some embodiments, a pop-up sprinkler head is disclosed. The pop-up sprinkler head can include a sprinkler body having an upper aperture and a lower opening adapted for connection to a pressurized liquid source, and a spray stem comprising an upper stem rotatably coupled to a base stem such that the upper stem rotates between an operational position where an upper stem interior cavity is in fluid communication with a base stem interior cavity and a maintenance position where the upper stem interior cavity is not in fluid communication with the base stem interior cavity. The pop-up sprinkler head can be adapted so that the spray stem slides between a retracted position where a majority of the spray stem is within the sprinkler body and an extended position where the spray stem extends through the upper aperture and above an upper extent of the sprinkler body.

These and other features, objects and advantages of the present invention will become more apparent to one skilled in the art from the following description and claims when read in light of the accompanying drawings.

DETAILED DESCRIPTION

A sprinkler head 10 is disclosed. The sprinkler head 10 is designed for ease of maintenance and repair of the spray nozzle and filter at the distal end of the sprinkler head spray stem. In some embodiments, the user can turn on a water supply to the sprinkler system to check the operation of the spray nozzles. When a clogged spray nozzle is identified, the spray stem is twisted to cut off the water supply to the upper spray stem and, therefore, the spray nozzle. If the sprinkler head is a pop-up sprinkler head, the spray stem will remain extended outside the sprinkler body because the external water pressure has not be removed. Thus, the spray stem remains extended, but water is not spraying during the maintenance process. The spray nozzle and/or filter can be removed and cleaned and the spray nozzle and/or filter replaced, if necessary. Once the maintenance has been completed, the stray stem is twisted back to the operational position and the water flow returns to the spray nozzle. This allows for convenient maintenance and repair without requiring the user to (1) go back and forth between the sprinkler control box and the sprinkler head to turn the water pressure on and off, and (2) stay dry because the water does not flow into the spray nozzle in the maintenance position.

Figure 7:
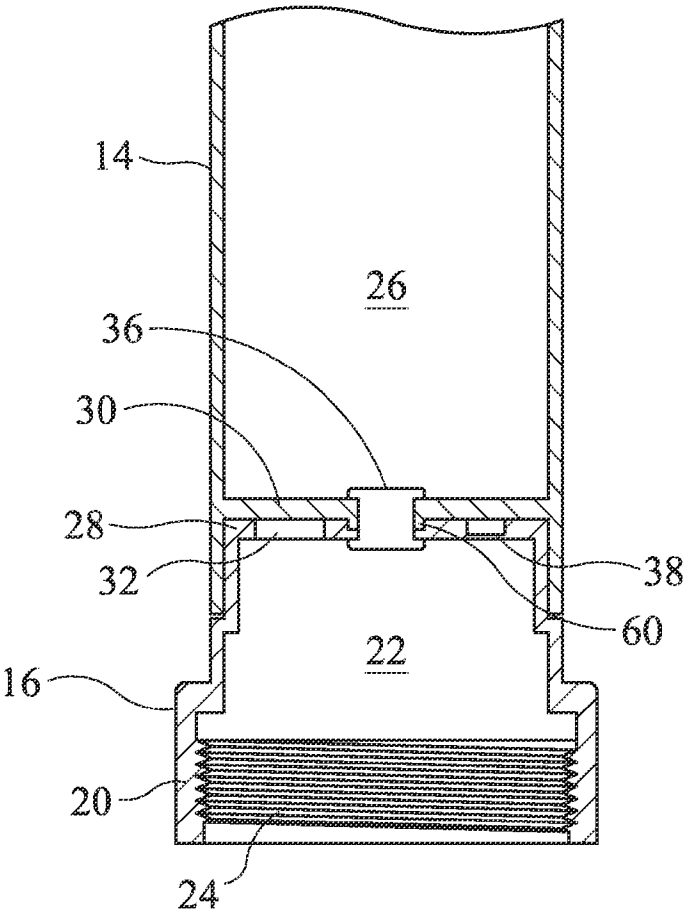
FIG. 7 is a cross-sectional view of the sprinkler head of FIG. 3 in the maintenance position.
Figure 17:
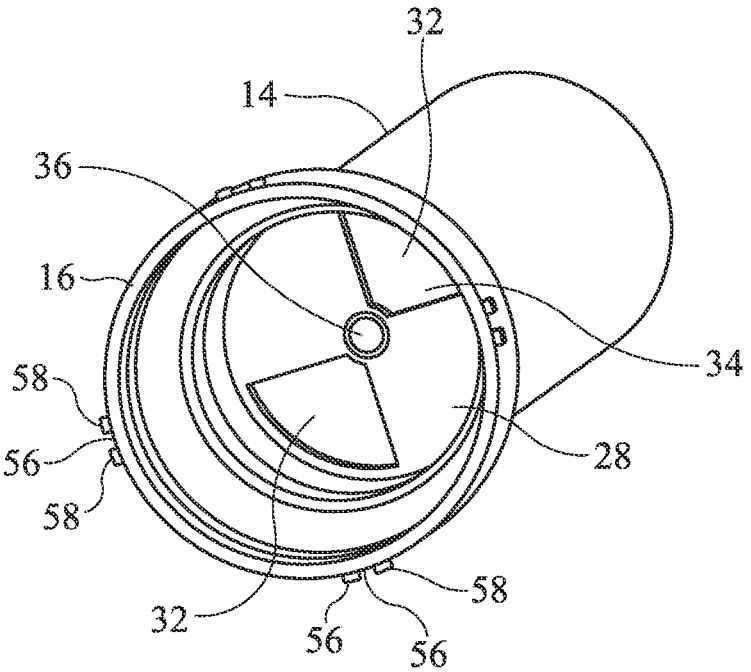
FIG. 17 is a bottom, perspective view of the assembled spray stem of FIG. 16 in the maintenance position.
Figure 18:
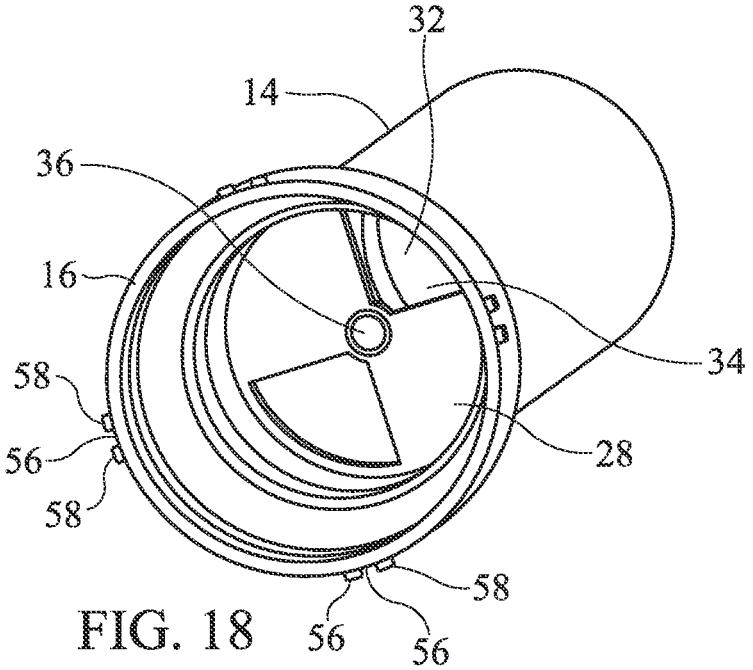
FIG. 18 is a bottom, perspective view of the assembled spray stem of FIG. 16 in the operational position.
Figure 19:
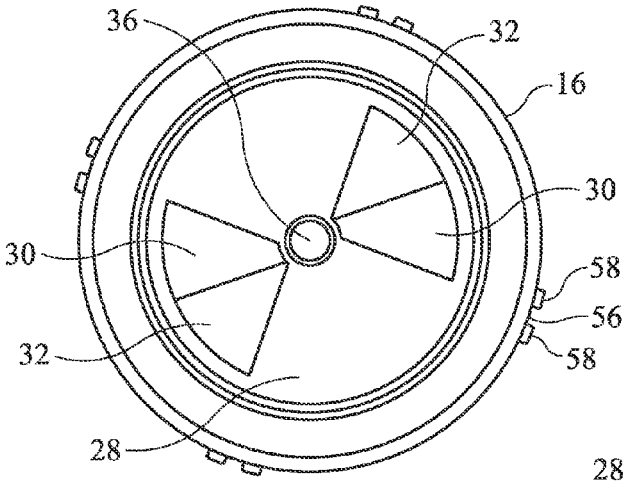
FIG. 19 is a bottom view of the assembled spray stem of FIG. 16 in an operational position, with a partial overlap of the orifices.
Figure 20:
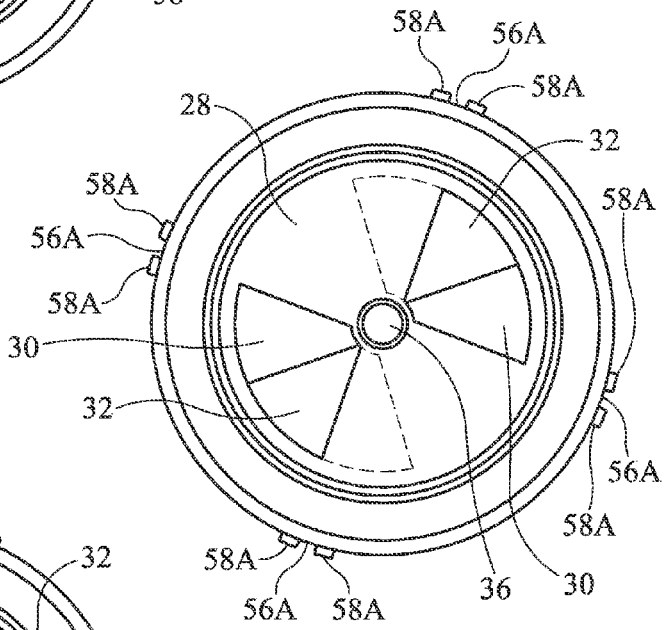
FIG. 20 is a partially-transparent view of FIG. 19.
Figure 21:
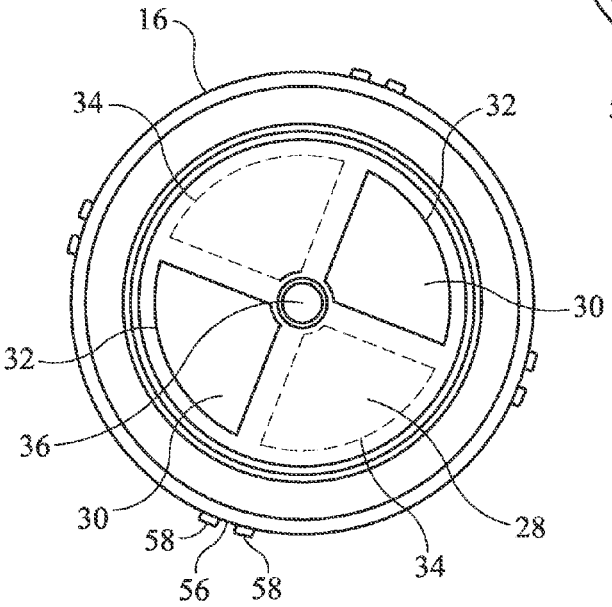
FIG. 21 is a partially-transparent, bottom view of the assembled spray stem of FIG. 16 in the maintenance position.

As shown in FIGS. 1-28, a sprinkler head 10 is disclosed. The sprinkler head 10 can include a spray stem 12 that includes an upper stem 14 rotatably coupled to a base stem 16; a spray nozzle 18 coupled to a distal end of the upper stem 14; and a connector 20 for removably coupling the sprinkler 10 head to a pressurized liquid source (S). The base stem interior cavity 22 can be in fluid communication with a connector interior cavity 24. The upper stem 14 can rotate between an operational position, as shown in FIGS. 6, 18-20 & 22-23, where an upper stem interior cavity 26 is in fluid communication with the base stem interior cavity 22, and a maintenance position, as shown in FIGS. 7, 17 & 21, where the upper stem interior cavity 26 is not in fluid communication with the base stem interior cavity 22.

As used herein, "pressurized" refers to pressures generally present in domestic water supplies, such as those conventionally used for domestic, commercial, or agricultural sprinkler systems used to maintain grass and landscaping plants.

As used herein, "not in fluid communication" is intended to include no fluid communication at all, as well as, instances where, when functioning at the standard operating pressure for the sprinkler system, the flow rate in the maintenance position is <33.3% of the flow rate in the operating position, or less than 25%, or less than 20%, or less than 15%, or less than 10%, or less than 7.5%, or less than 5%, or less than 2.5% of the operating position flow rate.

Figure 1:
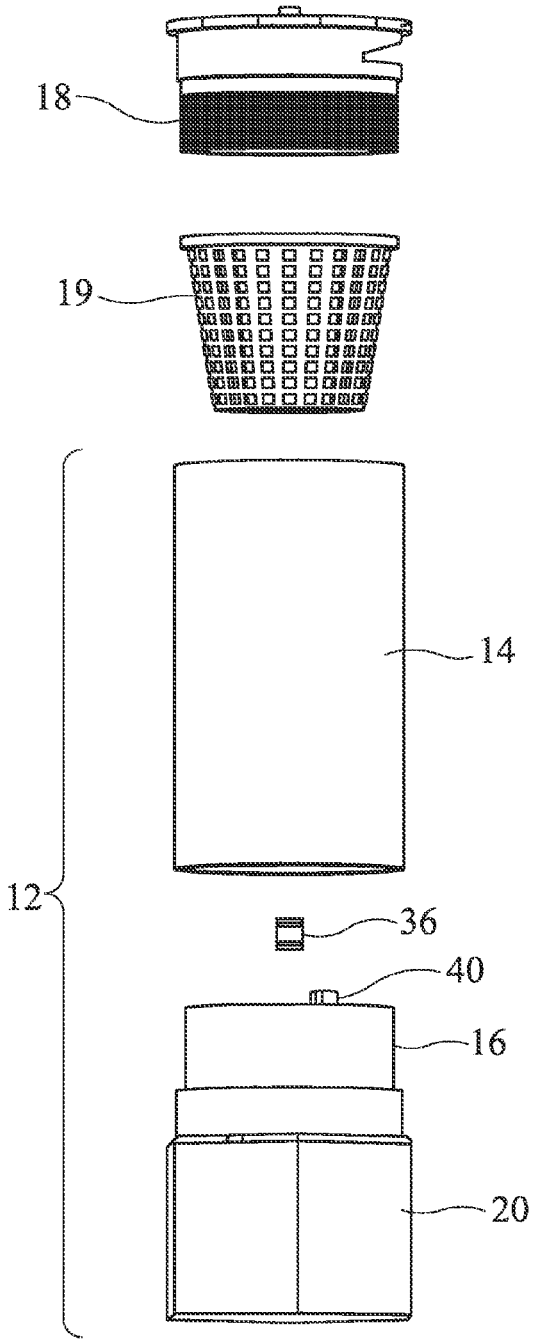
FIG. 1 is an exploded view of a sprinkler head as described herein.
Figure 2:
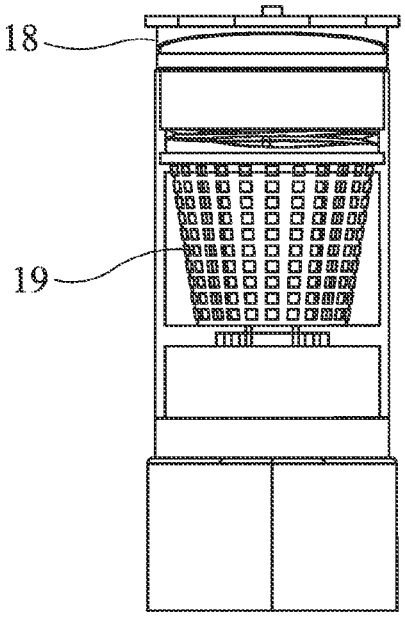
FIG. 2 is a semi-transparent view of an assembled sprinkler head of FIG. 1.
Figure 3:
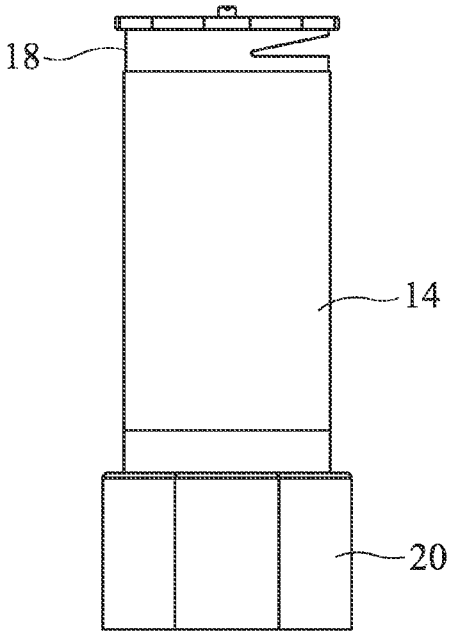
FIG. 3 is a side for of an assembled sprinkler head of FIG. 1.
Figure 4:
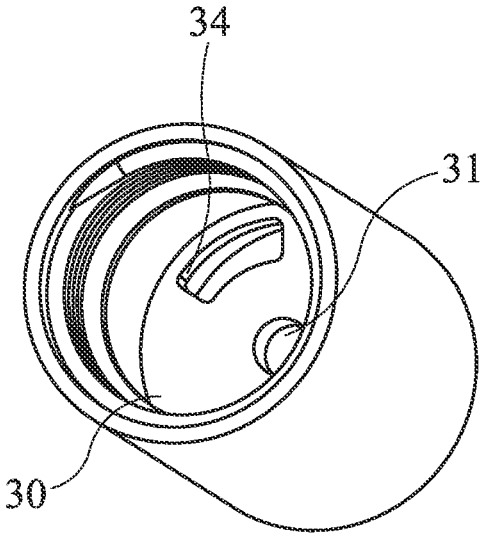
FIG. 4 is a top perspective view of an upper stem as described herein.
Figure 5:
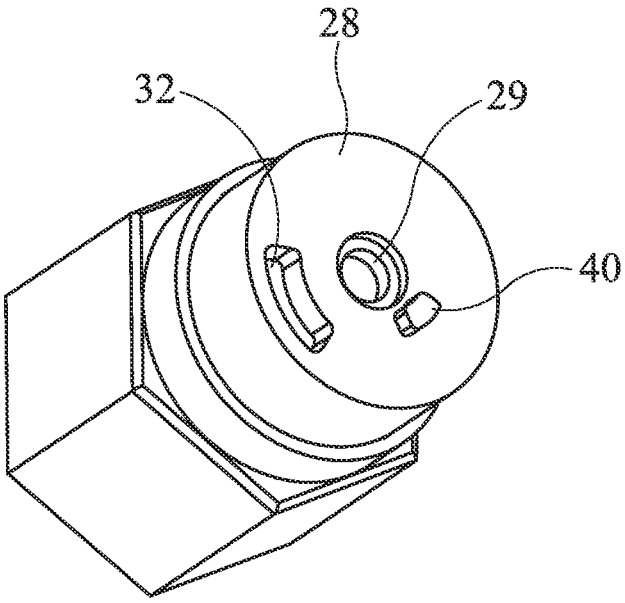
FIG. 5 is a top perspective view of a base stem as described herein.

In some embodiments, as best shown in FIGS. 1-3, the spray nozzle 18 can be removably coupled to a distal end of the upper stem 14. For example, the spray nozzle 18 can screw or snap into or onto the distal end of the upper stem 14.

Figure 22:
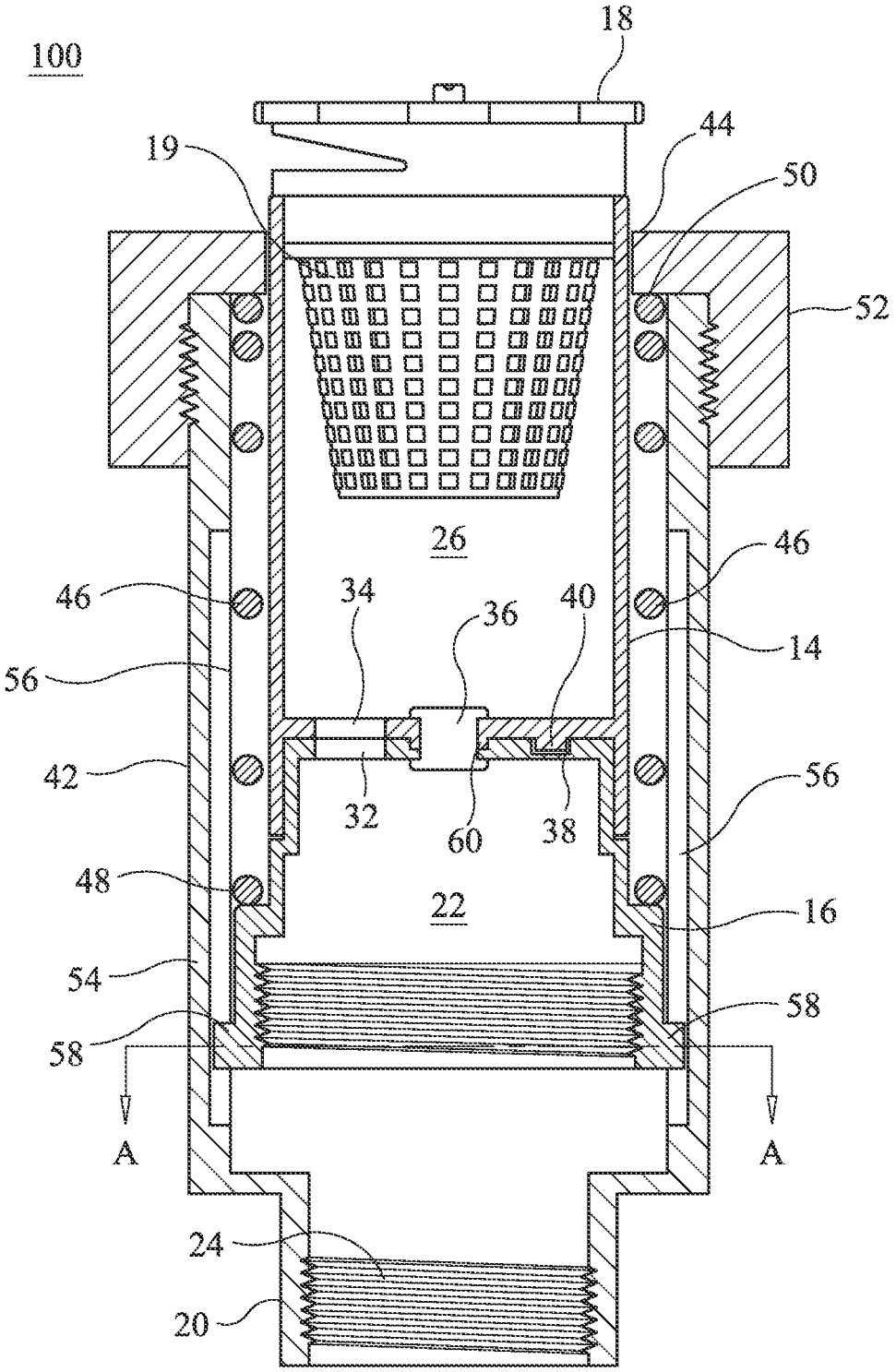
FIG. 22 is a cross-sectional view of a pop-up sprinkler head incorporating a spray stem (such as that shown in FIGS. 18-20) in the operational position, but in the retracted position (no water pressure).

As shown in FIGS. 1, 2 & 22, the sprinkler head 10 can also include a filter 19. The filter 19 can fit within the upper stem interior cavity 26 and can be removed when the spray nozzle 18 is removed from the distal end of the upper stem 14. In some embodiments, as best shown in FIG. 2, the filter 19 can be held within the upper stem interior cavity 26 by the spray nozzle 18. In other embodiments, the filter 19 and the spray nozzle 18 can be integrally formed.

In some embodiments, an upper face 28 of the base stem 16 is rotatably coupled to a lower face 30 of the upper stem 14, where the upper face 28 includes at least one base stem orifice 32 and the lower face 30 includes at least one upper stem orifice 34. In some embodiments, as shown in FIGS. 6, 18-20 & 22-23, the at least one base stem orifice 32 and the at least one upper stem orifice 34 overlap in the operational position. As shown in FIGS. 7, 17 & 21, the at least one base stem orifice 32 and the at least one upper stem orifice 34 do not overlap in the maintenance position.

In some embodiments, the base stem orifice(s) 32 are the same size and shape as the upper stem orifice(s) 34 with which they align in the operational position. As used herein, two orifices "overlap" if the partially or fully overlap (i.e., allow water to flow through the two orifices from the base stem interior cavity 22 to the upper stem interior cavity 26).

As shown in FIG. 4-7, in some embodiments, the at least one upper stem orifice 34 includes one upper stem orifice 34, and the at least one base stem orifice 32 includes one base stem orifice 32. As shown in FIGS. 9, 13 & 17-18, in some embodiments, the at least one upper stem orifice 34 includes a plurality of upper stem orifices 34, and the at least one base stem orifice 32 includes a plurality of base stem orifices 32. In some embodiments, as best shown in FIGS. 6, 7, 13, 22, 23, 27 and 28, the lower face 30 is recessed within the upper stem 14 (e.g., a proximal portion of the upper stem 14), and a portion of the upper stem 14 slides over a portion of the base stem 16.

In some embodiments, the rotation of the upper stem 14 relative to the base stem 16 is limited to less than 360 degrees. In some embodiments, the rotation of the upper stem 14 relative to the base stem 16 is limited to less 270 degrees, or less than 180 degrees, or less than 150 degrees, or less than 120 degrees.

In some embodiments, the upper face 28 of base stem 16 is rotatably coupled to the lower face 30 of upper stem 14. For example, the stems 14, 16 can be rotatably coupled by a fastener 36 (e.g., a rivet). In some embodiments, one of the upper face 28 and the lower face 30 includes a groove 38, and the other of the upper face 28 and the lower face 30 comprise a projection 40. In such embodiments, the projection 40 slides within the groove 38 to limit rotation of the upper stem 14 relative to the base stem 16 to less than 360 degrees. In some embodiments, the rotation of the upper stem 14 relative to the base stem 16 is limited by the groove-projection arrangement to less 270 degrees, or less than 180 degrees, or less than 150 degrees, or less than 120 degrees.

In some embodiments, as shown in FIGS. 6-7 & 22-23, the upper face 28 includes an upper face opening 29 and the lower face 30 includes a lower face opening 31, where the fastener 36 passes through the upper face opening 29 and the lower face opening 31 and is secured to the back side of the upper and lower faces 28, 30. In some embodiments, the upper face 28 is round and the upper face opening 29 is concentric with a center of the upper face 28. In some embodiments, the lower face 30 is round and the lower face opening 31 is concentric with a center of the lower face 31.

In some embodiments, one of the openings 29, 31 is circumscribed by a circular projection 60 and the circular projection nests within the other opening 31, 29. For example, as shown in FIGS. 5-7 & 22-23, in some embodiments one of the openings 29, 31 can have stepped sides and the circular projection 60 can fit within a wider portion of the stepped opening, while the fastener 36 fits through the circular projection 60 and the narrower portion of the stepped opening.

In some embodiments, one of the upper face 28 and the lower face 30 include a second groove $\mathbf{38}_B$, and the other of the upper face 28 and the lower face 30 comprise a second projection $\mathbf{40}_B$, wherein said first and second projections $\mathbf{40}_A$, $\mathbf{40}_B$ slide within the first and second grooves $\mathbf{38}_A$, $\mathbf{38}_B$ to limit rotation of the upper stem to less than 270 degrees. In some embodiments, the rotation of the upper stem 14 relative to the base stem 16 is limited by the groove-projection arrangement to less than 180 degree, less than 150 degrees, or less than 100 degrees.

In some embodiments, the lower face 30 is round and the at least one upper stem orifice 34 is symmetric about a diameter of the lower face 30. In some embodiments, the lower face 30 is round, and the at least one upper stem orifice 34 and the groove 38/projection 40 are symmetric about a diameter of the lower face 30. In some embodiments, the upper face 28 is round and the at least one base stem orifice 32 is symmetric about a diameter of the upper face 28. In some embodiments, the upper face 28 is round, and the at least one base stem orifice 32 and the projection 40/groove 38 are symmetric about a diameter of the upper face 28.

Figure 27B:
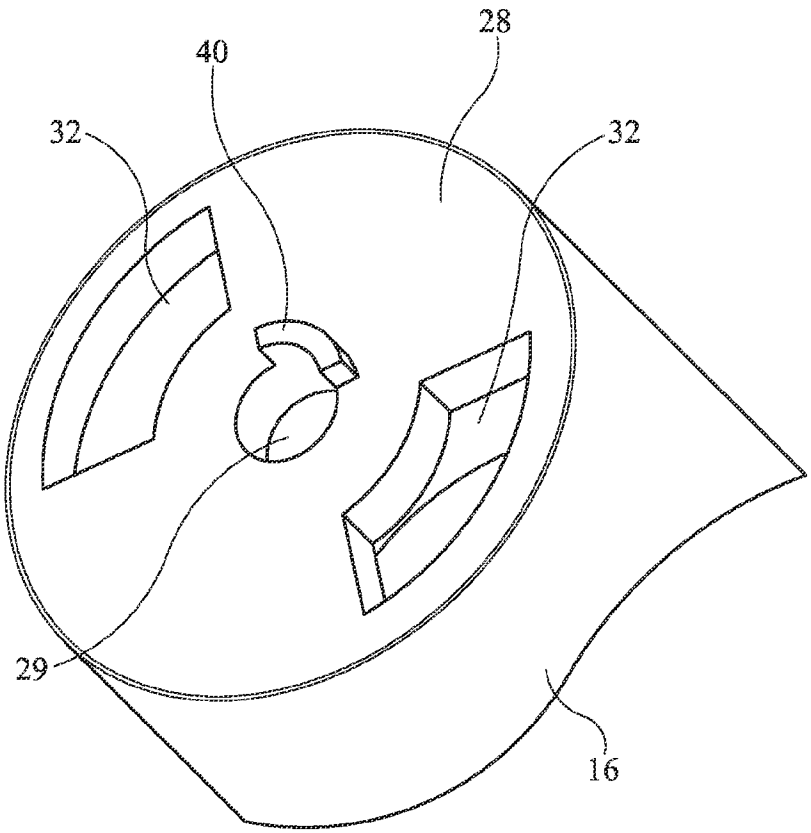
FIGS. 27A and 27B are perspective views of a base stem with a projection located immediately adjacent to the upper face opening thereof.
Figure 27A:
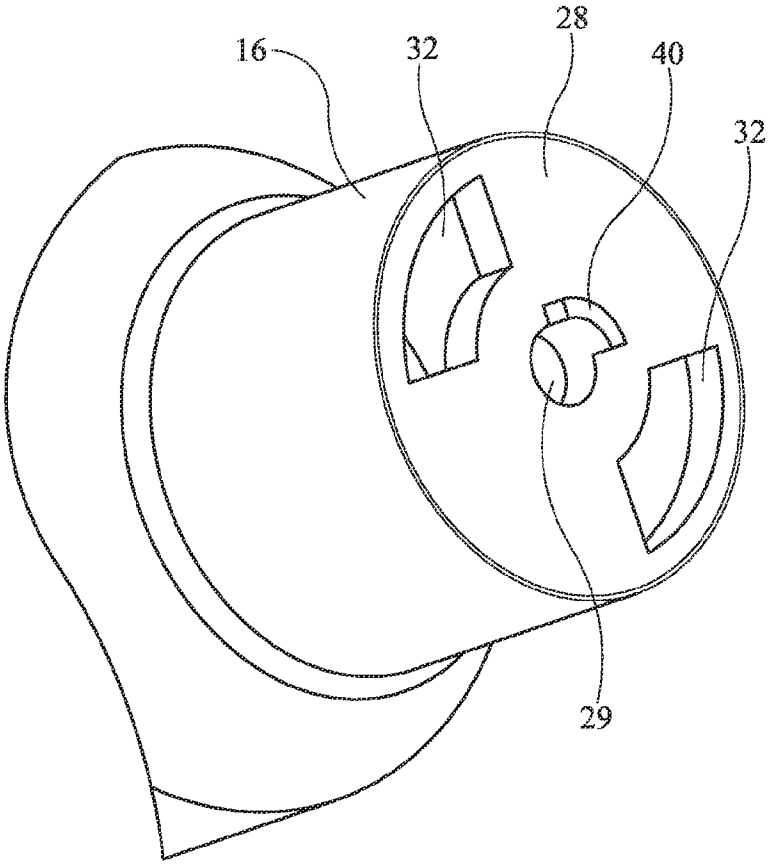
Figure 28B:
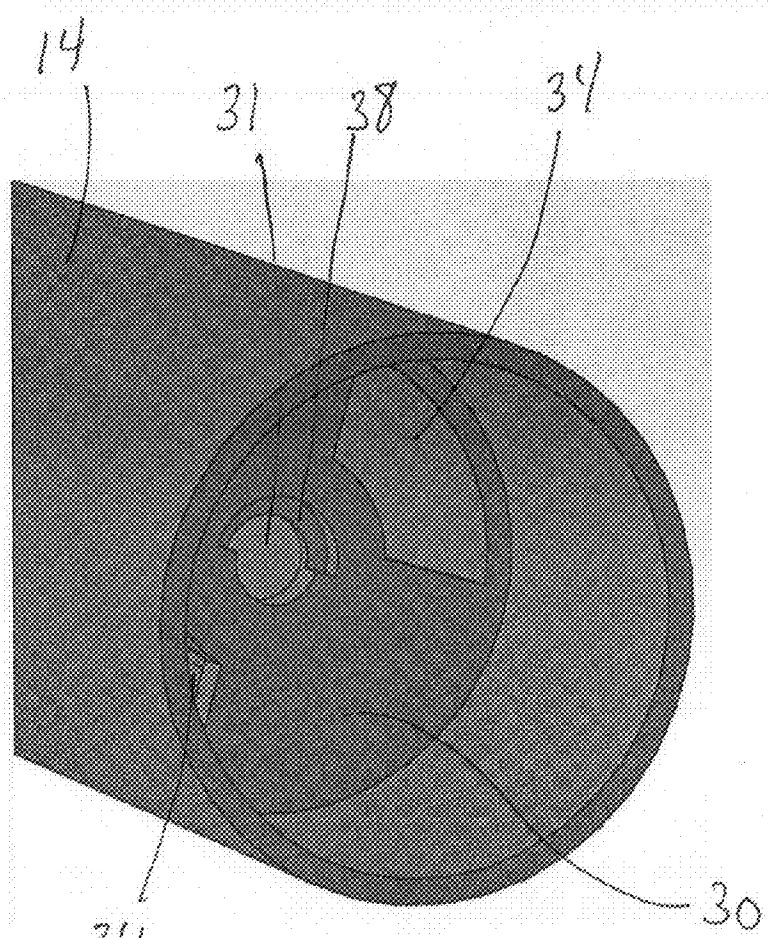
FIGS. 28A and 28B are perspective views of an upper stem with a groove located immediately adjacent to the lower face opening thereof.
Figure 28A:
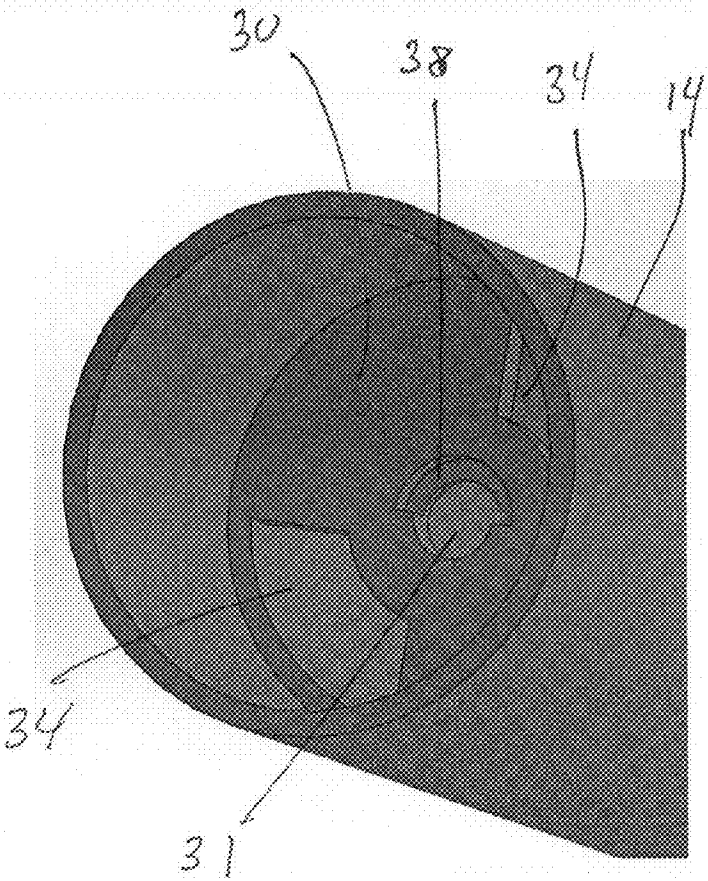

In some embodiments, as shown in FIGS. 27-28, the groove 38 is immediately adjacent to one of the openings 29, 31, and the projection 40 is immediately adjacent to the other one of the openings 31, 29. In some embodiments, as shown in FIGS. 27A and 27B, the inner surface of one of the openings 29, 31 is continuous with an inner surface of the projection 40. In some embodiments, as shown in FIG. 28, the groove 38 is formed by a cut-out adjacent to one of the opening 29, 31 and, as will be apparent, when the spray stem 12 is assembled, the inner wall of the groove 38 is the fastener 36 extending through the upper face opening 29 and lower face opening 31. In such embodiments, when the spray stem 12 is assembled, the projection 40 extends between the fastener 36 and an outer wall of the groove 38. It should be understood that, for any of the embodiments disclosed herein, particular placement of the projection 40 and groove 38 can be reversed (i.e., from base stem 16 to upper stem 14 or vice versa) or relocated (i.e., either immediately adjacent to the openings 29, 31 or not).

Figure 6:
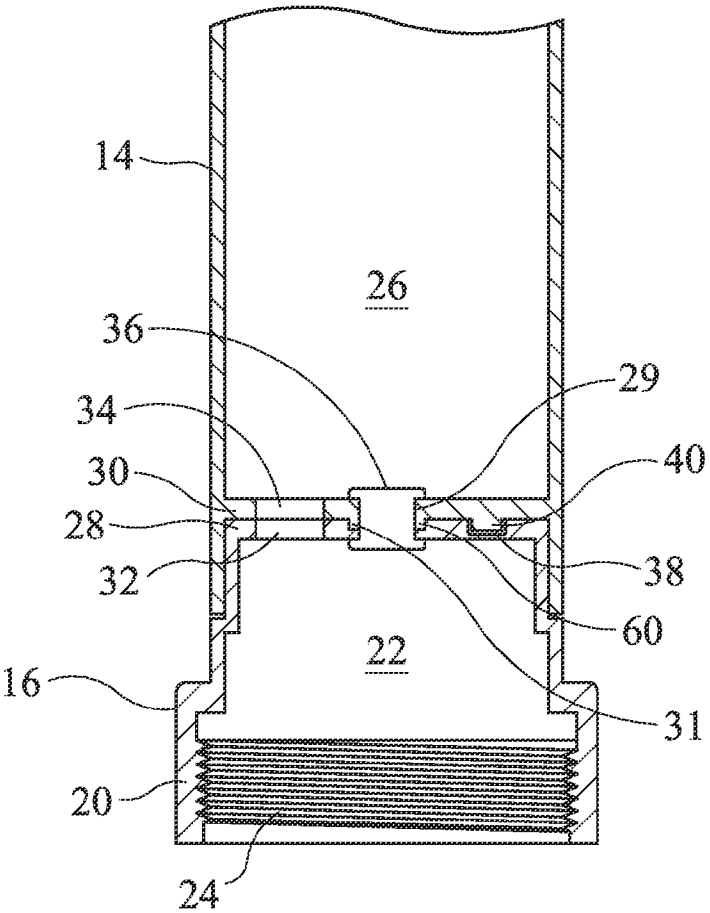
FIG. 6 is a cross-sectional view of the sprinkler head of FIG. 3 in the operational position.
Figure 8:
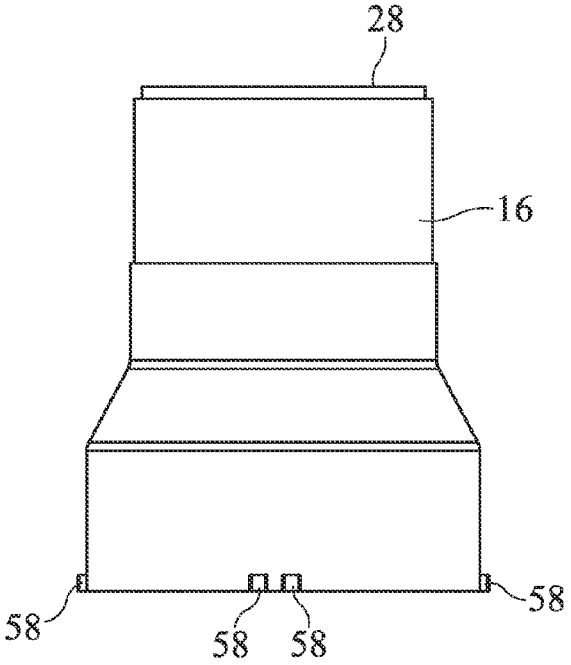
FIG. 8 is a front view of a base stem for use in a pop-up sprinkler head.
Figure 9:
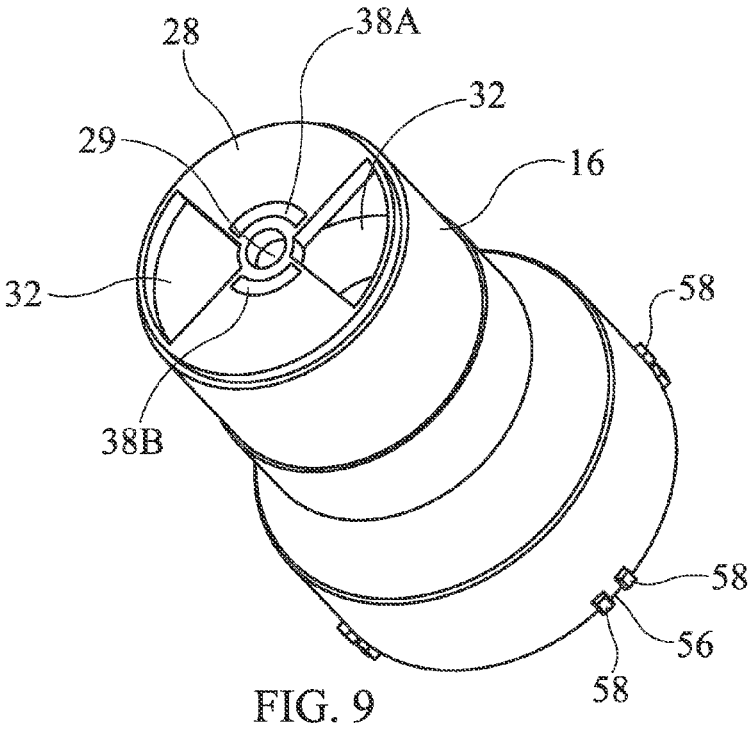
FIG. 9 is a front, perspective view of the base stem of FIG. 8.
Figure 10:
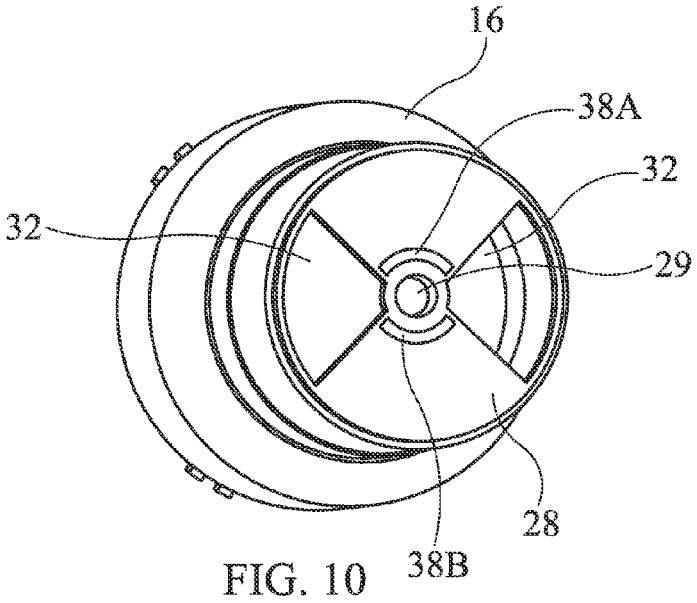
FIG. 10 is a top, perspective view of the base stem of FIG. 8.
Figure 11:
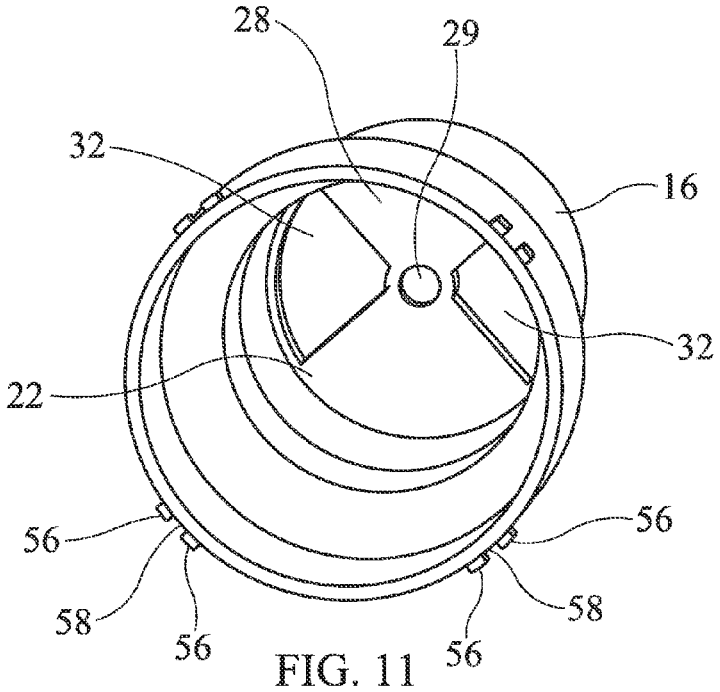
FIG. 11 is a bottom, perspective view of the base stem of FIG. 8.
Figure 12:
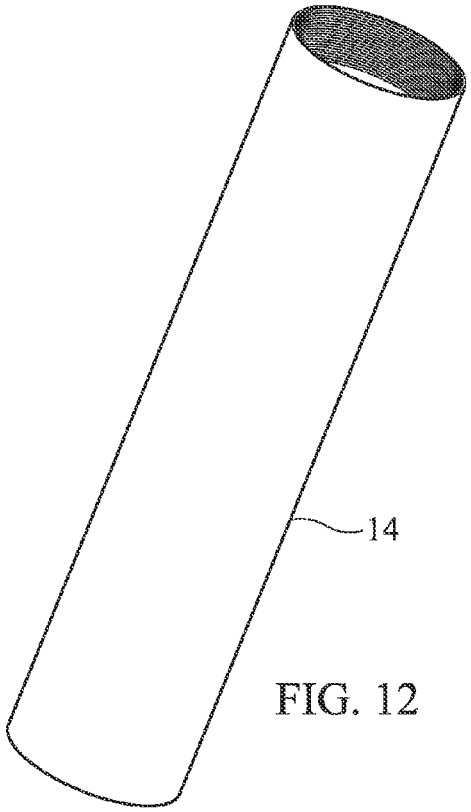
FIG. 12 is a front, perspective view of an upper stem that could be used with the base stem of FIG. 8.
Figure 13:
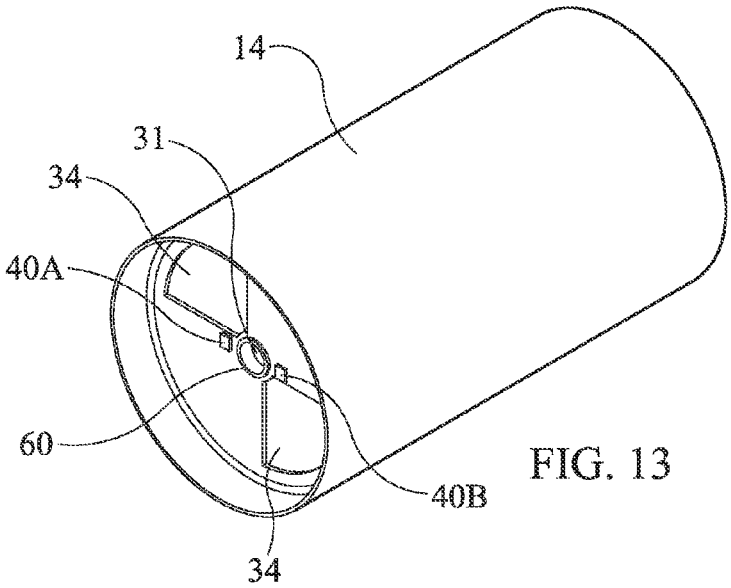
FIG. 13 is a bottom, perspective view of the upper stem of FIG. 12.
Figure 14:
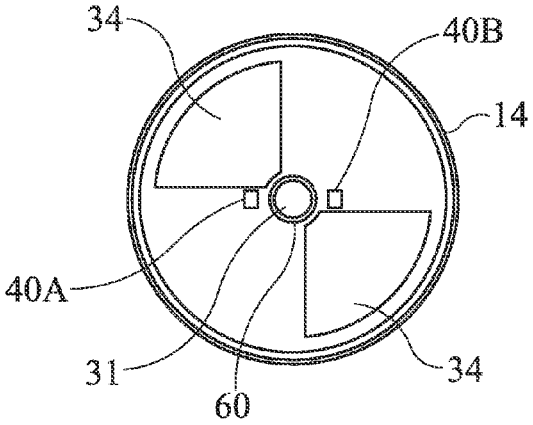
FIG. 14 is a bottom view of the upper stem of FIG. 12.
Figure 16:
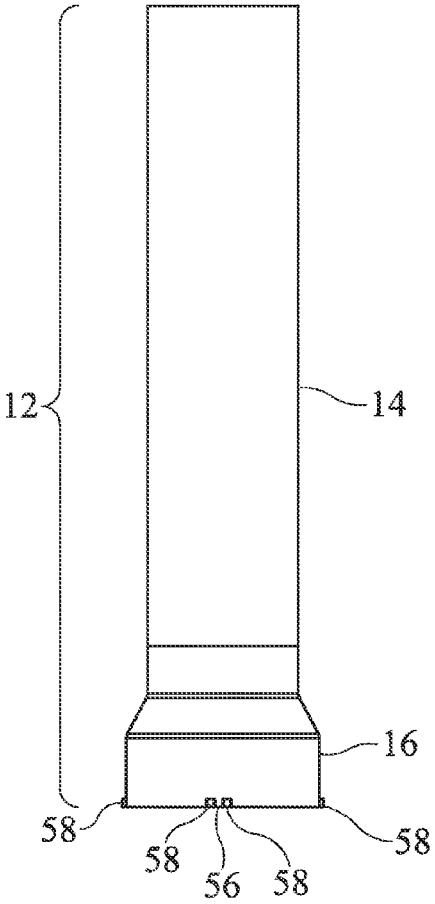
FIG. 16 is a front view of an assembled spray stem without a spray nozzle.
Figure 15:
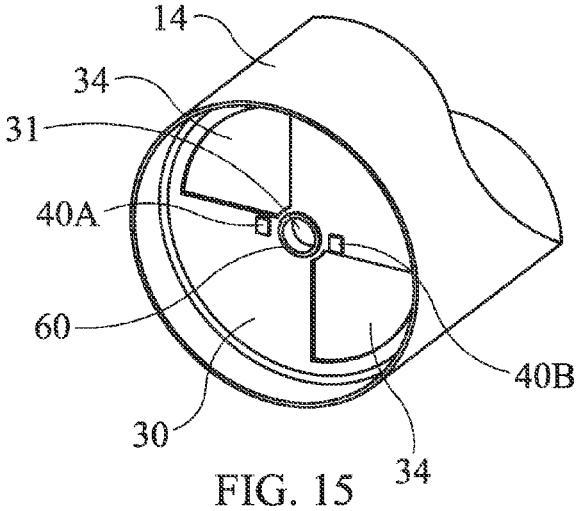
FIG. 15 is a close-up, bottom perspective view of the upper stem of FIG. 12.

In some embodiments, such as that shown in FIGS. 6-7, a proximal end 42 of the base stem 16 comprises the connector 20. In some embodiments, the base stem 16 and the connector 20 can be formed of an integral piece made from a single piece (e.g., formed in the same injection mold). In some embodiments, the connector 20 can be rotatably coupled to a proximal end of the base stem 16 to facilitate coupling to a pressurize liquid (e.g., water) source.

Figure 23:
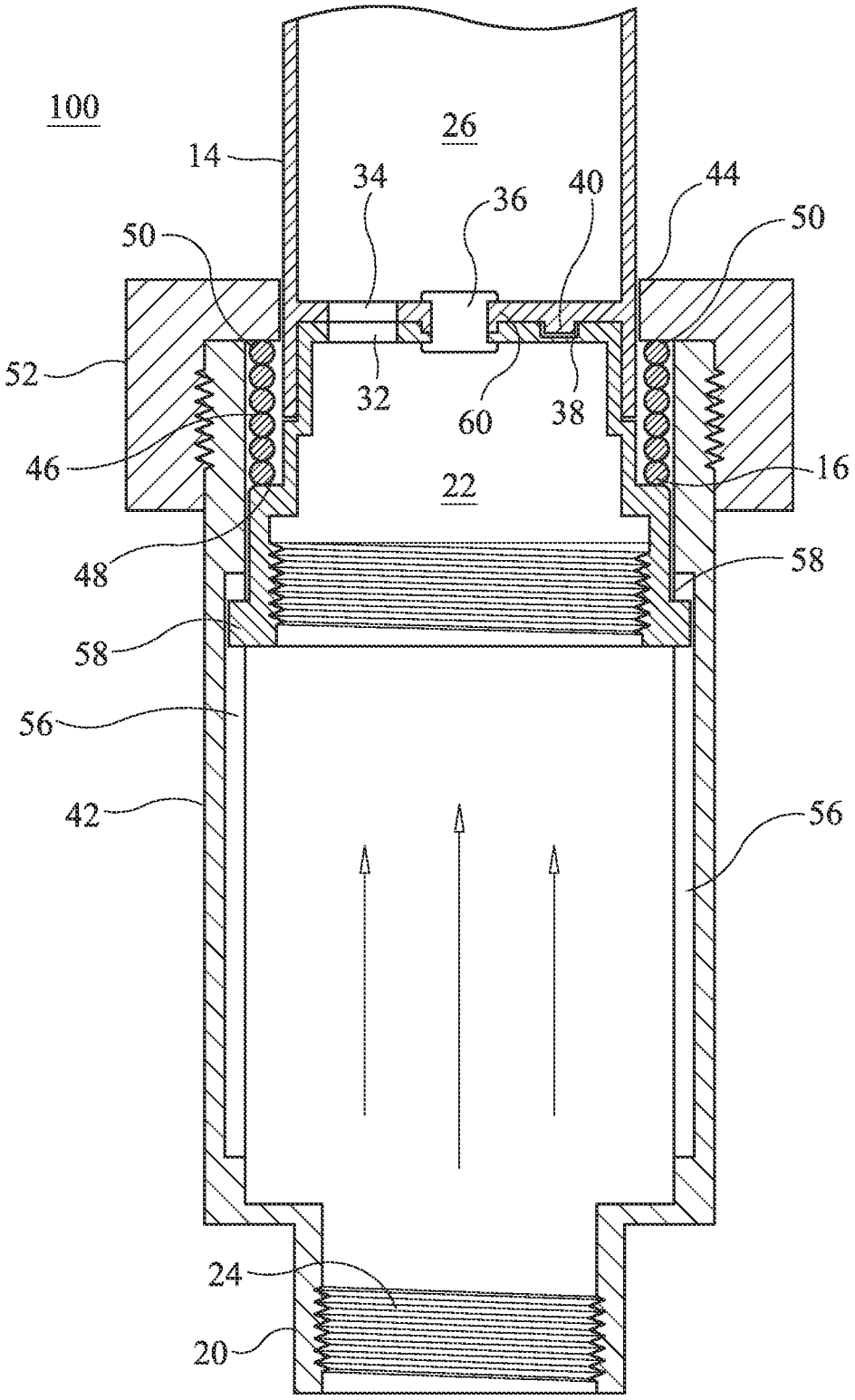
FIG. 23 is a cross-sectional view of a pop-up sprinkler head incorporating a spray stem (such as that shown in FIGS. 18-20) in the operational position and the extended position.

In some embodiments, such as those shown in FIGS. 22-23, the sprinkler head can be a pop-up sprinkler head 100. The pop-up sprinkler head 100 can include a spray stem 12 with a rotatable mechanism that can be identical to those already described and those described below. The primary difference between the spray stem 10 used in the pop-up sprinkler head 100 and the shrub spray sprinkler head 10 disclosed above is that the base stem 12 is adapted to slidably couple to a cylindrical or generally cylindrical sprinkler body 42, which includes the connector 20 at a first end of the sprinkler body 42.

In some embodiments, the sprinkler body 42 includes the connector 20 at a first end and an upper aperture 44 at a second end opposite the first end. In some embodiments, the spray stem 12 slides between a retracted position where a majority of the spray stem 12 is within the sprinkler body 42 and an extended position where the spray stem 12 extends through the upper aperture 44 and above an upper extent of the sprinkler body 42. An example of the spray stem 12 in a retracted position is shown in FIG. 22, while an example of the same pop-up sprinkler head 100 with the spray stem in the extended position is shown in FIG. 23.

In some embodiments, the spray stem 12 is biased toward the retracted position. For example, as shown in FIGS. 22-23, a coiled spring 46 can have one end resting against a base stem lip 48 and an opposite end resting against an opposing surface 50 of the sprinkler body 42. As shown in FIGS. 22-23, the spray stem 12 can pass through the longitudinal axis of the coiled spring 46. In some embodiments, as shown in FIG. 22-23, the opposing surface 50 can be an interior surface of a sprinkler body lid 52.

In some embodiments, the sprinkler body lid 52 can be removably coupled to the sprinkler body base 54. For example, the sprinkler body lid 52 can screw onto the sprinkler body base 54. As is apparent from FIGS. 22-26, corresponding portions of the sprinkler body lid 52 and the sprinkler body base 54 can be cylindrical.

In some embodiments, the spray stem 12 slides toward the extended position (e.g., FIG. 23) when pressurized liquid is supplied to the connector 20 and the spray stem 12 slides toward the retracted position (e.g., FIG. 22) when liquid pressure is removed.

In some embodiments, a majority of the upper stem 14 extends out of the sprinkler body 42 in the extended position. In some embodiments, at least 70% of the upper stem 14 extends out of the sprinkler body 42 in the extended position. In some embodiments, at least 85%, at least 90%, at least 95%, of the entire upper stem 14 extends out of the sprinkler body 42 in the extended position.

In some embodiments, the base stem 16 and the sprinkler body 42 are slidably coupled to one another. In some embodiments, the base stem 16 is in direct contact with the sprinkler body 42, while the base stem 16 and the sprinkler body 42 can be slidably coupled via a ratchet ring. In such embodiments, the ratchet ring can include an inner opening that the base stem fits through and an outer edge that slidably couples to the sprinkler body. The surfaces of the ratchet ring and the base stem that contact one another can be include a series of peaks and valleys so that they do not rotate relative to one another unless a threshold force in the direction of rotation is overcome. This enables a user to twist the upper stem 14 relative to the base stem 16 to turn the water flow on or off, and also adjust the spray zone by twisting the base stem 16 relative to the sprinkler body 42 via the ratchet ring.

Figure 26:
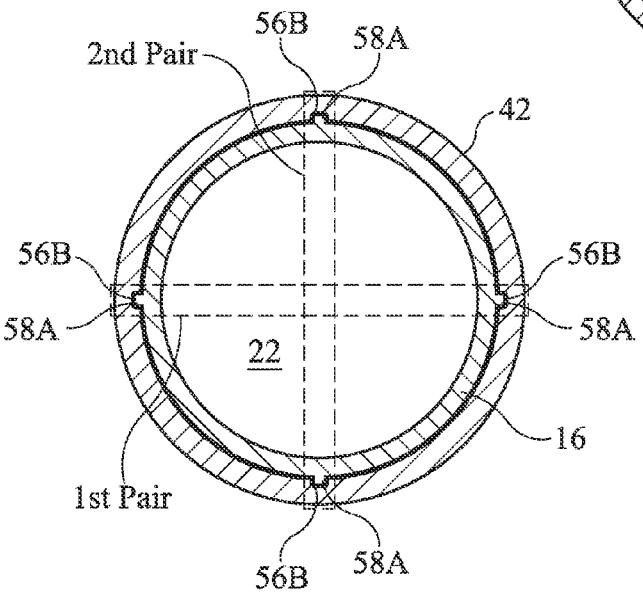
FIG. 26 is a third example of a cross-sectional view of the pop-up sprinkler of FIG. 22 taken along cut line A-A.

In some embodiments, the base stem 16 and the sprinkler body 42 are slidably coupled to one another by at least one channel 56 and fin 58 configuration. In some embodiments, there is at least one pair of opposing channels 56 and fins 58. For example, as shown in FIG. 26, in some embodiments there are two pairs of opposing channels 56 and fins 58. In some embodiments, there can be at least two pairs of opposing channels 56 and fins 58, or at least three pairs of opposing channels 56 and fins 58, or at least four pairs of opposing channels 56 and fins 58.

Figure 24:
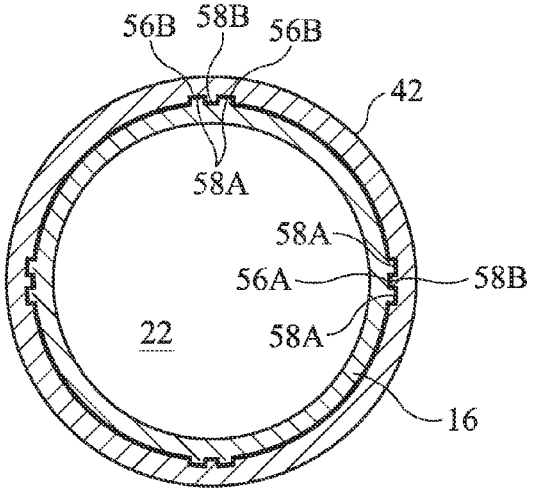
FIG. 24 is an example of a cross-sectional view of the pop-up sprinkler of FIG. 22 taken along cut line A-A.
Figure 25:
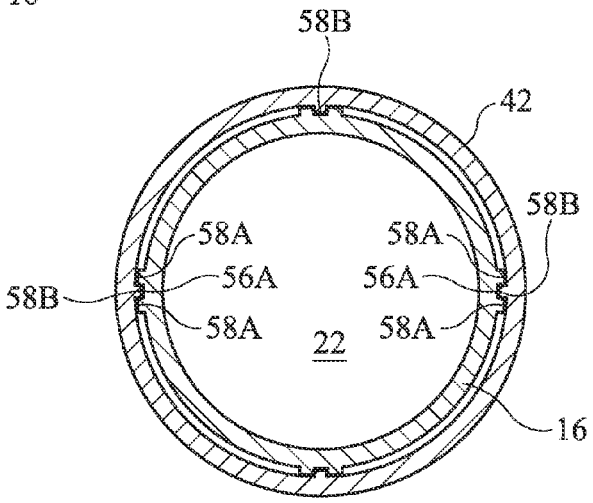
FIG. 25 is a second example of a cross-sectional view of the pop-up sprinkler of FIG. 22 taken along cut line A-A.

In some embodiments, such as that shown in FIG. 24-25, a space between a pair of adjacent fins $\mathbf{58}_A$ can define a channel $\mathbf{56}_A$ in the base stem 16 or sprinkler body 42. Similarly, in such embodiments, the corresponding portion of the sprinkler body 42 or base stem 16 that fits into the channel $\mathbf{56}_A$ can serve as a fin $\mathbf{58}_B$. The designations A and B are used in this paragraph to clarify which features are on a first (A) of the base stem 16 or sprinkler body 42, and which are on the other (B) of the sprinkler body 42 or base stem 16.

In some embodiments, the base stem 16 is coupled to the sprinkler body 42 to avoid rotation of the base stem 16 relative to the sprinkler body 42. Examples of techniques for preventing rotation of the base stem 16 relative to the sprinkler body 42 include the channel 56 and fin 58 configuration described above. This ensures that when the spray stem 12 is in the extended position and the upper stem 14 is rotated, the upper stem 14 rotates relative to the base stem 16 between the operational position and the maintenance position, while the base stem 16 does not rotate relative to the sprinkler body 42.

In some additional embodiments, a pop-up sprinkler head 100 is described. The pop-up sprinkler head 100 can include a sprinkler body 42 and a spray stem 12 comprising an upper stem 14 rotatably coupled to a base stem 16. The sprinkler body 42 can include an upper aperture 44 and a lower opening 20 adapted for connection to a pressurized liquid source. The upper stem 14 can be rotated relative to the base stem 16 between an operational position where an upper stem interior cavity 26 is in fluid communication with a base stem interior cavity 22 and a maintenance position where the upper stem interior cavity 26 is not in fluid communication with the base stem interior cavity 22. The spray stem 12 can slide between a retracted position where a majority of the spray stem 12 is within the sprinkler body and an extended position where the spray stem 12 extends through the upper aperture and above an upper extent of the sprinkler body 42. In some embodiments, a spray nozzle 18 is coupled to a distal end of the upper stem 14.

The foregoing is provided for purposes of illustrating, explaining, and describing embodiments of this invention. Modifications and adaptations to these embodiments will be apparent to those skilled in the art and may be made without departing from the scope or spirit of this invention.

What is claimed is:

1. A sprinkler head, comprising:

a spray stem comprising an upper stem rotatably coupled to a base stem at a junction;

a spray nozzle coupled to a distal end of the upper stem; and a connector for removably coupling the sprinkler head to a pressurized liquid source, wherein a base stem interior cavity is in fluid communication with a connector interior cavity, wherein the base stem interior cavity is longitudinally upstream of the junction and the upper stem interior cavity is longitudinally downstream of the junction, wherein an upper face of said base stem abuts a lower face of upper stem, wherein one of the upper face and the lower face comprises a recess therein, and the other of the upper face and the lower face comprises a projection extending longitudinally into the recess, respectively, wherein said projection slides within the recess to limit rotation of the upper stem to less than 360 degrees, wherein the upper stem rotates between an operational position where an upper stem interior cavity is in fluid communication with the base stem interior cavity and a maintenance position where the upper stem interior cavity is not in fluid communication with the base stem interior cavity, and wherein said upper stem interior cavity is in fluid communication with the spray nozzle both when the upper stem is in the operational position and when the upper stem is in the maintenance position.

2. The sprinkler head according to claim 1, wherein an upper face of the base stem is rotatably coupled to a lower face of the upper stem, wherein the upper face comprises at least one base stem orifice and the lower face comprises at least one upper stem orifice, wherein the at least one base stem orifice and the at least one upper stem orifice overlap in the operational position, while the at least one base stem orifice and the at least one upper stem orifice do not overlap in the maintenance position.

3. The sprinkler head according to claim 2, wherein said at least one upper stem orifice comprises a plurality of upper stem orifices, and said at least one base stem orifice comprises a plurality of base stem orifices.

4. The sprinkler head according to claim 1, wherein one of the upper face and the lower face comprise a second recess therein, and the other of the upper face and the lower face comprise a second projection adapted to extend longitudinally into the recess, wherein said projections slide within the recesses to limit rotation of the upper stem to less than 270 degrees.

5. The sprinkler head according to claim 1, further comprising:

a sprinkler body comprising said connector at a first end and an upper aperture at a second end opposite said first end, wherein the spray stem slides between a retracted position where a majority of the spray stem is within the sprinkler body and an extended position where the spray stem extends through the upper aperture and above an upper extent of said sprinkler body.

6. The sprinkler head according to claim 5, wherein said spray stem is biased toward said retracted position.

7. The sprinkler head according to claim 5, wherein said spray stem slides toward the extended position when pressurized liquid is supplied to the connector and slides toward the retracted position when liquid pressure is removed.

8. The sprinkler head according to claim 5, wherein a majority of the upper stem extends out of the sprinkler body in the extended position.

9. The sprinkler head according to claim 5, wherein said base stem and said sprinkler body are slidably coupled to one another by at least one channel and grove configuration.

10. The sprinkler head according to claim 5, wherein said base stem is coupled to said sprinkler body to avoid rotation of said base stem relative to said sprinkler body.

11. The sprinkler head according to claim 5, wherein an upper face of the base stem is rotatably coupled to a lower face of the upper stem, wherein the upper face comprises at least one base stem orifice and the lower face comprises at least one upper stem orifice, wherein the at least one base stem orifice and the at least one upper stem orifice overlap in the operational position, while the at least one base stem orifice and the at least one upper stem orifice do not overlap in the maintenance position.

12. The sprinkler head according to claim 11, wherein said at least one upper stem orifice comprises a plurality of upper stem orifices, and said at least one base stem orifice comprises a plurality of base stem orifices.

13. A pop-up sprinkler head, comprising:

a sprinkler body having an upper aperture and a lower opening adapted for connection to a pressurized liquid source, a spray stem comprising an upper stem rotatably coupled to a base stem at a junction, wherein an upper face of said base stem abuts a lower face of upper stem, wherein one of the upper face and the lower face comprises a recess therein, and the other of the upper face and the lower face comprises a projection extending longitudinally into the recess, respectively, wherein said projection slides within the recess to limit rotation of the upper stem to less than 360 degrees, wherein the upper stem rotates between an operational position where an upper stem interior cavity is in fluid communication with a base stem interior cavity and a maintenance position where the upper stem interior cavity is not in fluid communication with the base stem interior cavity, wherein the base stem interior cavity is longitudinally upstream of the junction and the upper stem interior cavity is longitudinally downstream of the junction, wherein said spray stem slides between a retracted position where a majority of the spray stem is within the sprinkler body and an extended position where the spray stem extends through the upper aperture and above an upper extent of said sprinkler body, and wherein said upper stem interior cavity remains in fluid communication with the spray nozzle both when the upper stem is in the operational position and when the upper stem is in the maintenance position.

14. A sprinkler head, comprising:

a spray stem comprising an upper stem rotatably coupled to a base stem;

a spray nozzle coupled to a distal end of the upper stem, wherein a nozzle spray opening is in a longitudinally extending side of the spray nozzle; and a connector for removably coupling the sprinkler head to a pressurized liquid source, wherein an upper face of the base stem includes an upper face opening and the lower face of the upper stem includes a lower face opening, where a fastener passes through the upper face opening and the lower face opening to rotatably couple the upper stem to the base stem, wherein a base stem interior cavity is in fluid communication with a connector interior cavity, and wherein the upper stem rotates between an operational position where an upper stem interior cavity is in fluid communication with the base stem interior cavity and a maintenance position where the upper stem interior cavity is not in fluid communication with the base stem interior cavity, wherein the base stem interior cavity is longitudinally upstream of the junction and the upper stem interior cavity is longitudinally downstream of the junction, and wherein said upper stem interior cavity remains in fluid communication with the spray nozzle both when the upper stem is in the operational position and when the upper stem is in the maintenance position.

15. The sprinkler head according to claim 1, wherein an upper face of the base stem includes an upper face opening and the lower face of the upper stem includes a lower face opening, where a fastener passes through the upper face opening and the lower face opening to rotatably couple the upper stem to the base stem.

16. The sprinkler head according to claim 1, further comprising a removable filter at a distal end of the upper stem interior cavity, wherein the filter is held within the upper stem interior cavity upstream of the spray nozzle.

17. The sprinkler head according to claim 14, wherein the fastener is a rivet.

18. The sprinkler head according to claim 14, wherein an upper face of said base stem abuts a lower face of upper stem, wherein one of the upper face and the lower face comprises a recess therein, and the other of the upper face and the lower face comprises a projection extending longitudinally into the recess, respectively, wherein said projection slides within the recess to limit rotation of the upper stem to less than 360 degrees.

* * * * *